US005474128A

United States Patent [19]

Bitting

[11] Patent Number: 5,474,128

[45] Date of Patent: Dec. 12, 1995

[54] TELESCOPING CONDUITS FOR INCREASING THE FLUID RESISTANCE OF WELL PRODUCTION TUBING INADVERTENTLY DROPPED IN AN OIL OR GAS WELL

[75] Inventor: George C. Bitting, Clayton, Mo.

[73] Assignee: Best Tool Co., Inc., Midland, Tex.

[21] Appl. No.: 86,937

[22] Filed: Jul. 2, 1993

[51] Int. Cl.[6] ..... E21B 17/02; E21B 34/12

[52] U.S. Cl. ..... 166/242.7; 166/332.1

[58] Field of Search ..... 166/334, 332, 166/242, 105.5; 175/21, 22, 314, 317

[56] References Cited

U.S. PATENT DOCUMENTS

| | | | |
|---|---|---|---|
| 73,688 | 1/1868 | Arnold | 175/314 X |
| 903,314 | 10/1908 | Porter . | |
| 1,317,197 | 9/1919 | Kunkel . | |
| 1,601,676 | 9/1926 | Burright | 166/334 |
| 1,603,874 | 10/1926 | Scott et al. . | |
| 1,974,868 | 9/1934 | Hewgley | 166/334 |
| 2,006,105 | 6/1935 | Maguire et al. . | |
| 2,331,631 | 10/1943 | Rogers et al. . | |
| 2,346,602 | 4/1944 | O'Bannon . | |
| 2,418,500 | 8/1947 | Chambers . | |
| 2,495,642 | 1/1950 | Penick | 166/334 |
| 2,549,198 | 4/1951 | Hayward | 166/334 |
| 2,578,996 | 12/1951 | Endersby | 175/22 |
| 2,663,307 | 12/1953 | Birdwell | 166/334 |
| 2,809,013 | 10/1957 | Ledgerwood, Jr. et al. | 175/317 |
| 2,906,493 | 9/1959 | Whitener | 175/317 X |
| 3,379,259 | 4/1968 | Metler . | |
| 3,526,278 | 9/1970 | Scott | 166/334 X |
| 4,366,861 | 1/1983 | Milam . | |
| 4,515,608 | 5/1985 | Clegg . | |
| 4,676,308 | 1/1987 | Chow . | |
| 4,768,589 | 9/1988 | Roeder . | |
| 5,176,216 | 1/1993 | Slater et al. . | |

FOREIGN PATENT DOCUMENTS

| | | |
|---|---|---|
| 948556 | 6/1974 | Canada . |

*Primary Examiner*—Hoang C. Dang
*Attorney, Agent, or Firm*—Rogers, Howell & Haferkamp

[57] ABSTRACT

A pair of telescoping conduits are attached to oil or gas well production tubing which is hung or being run in a cased hole to increase the fluid resistance of the tubing if it is dropped in the hole and descends through fluid contained in the casing. The pair of telescoping conduits are attached to the production tubing to reduce the risk of damage or loss to the casing pipe, the tubing or the well itself when a length of the production tubing having the telescoping conduits attached is inadvertently dropped into and through the casing. In addition, the invention will lessen the cost of "fishing" the dropped tubing out of the hole by reducing the chances of its becoming stuck when it hits bottom. In one embodiment the telescoping tubing is adapted to also separate gas from liquid entering the production tubing.

8 Claims, 2 Drawing Sheets

TELESCOPING CONDUITS FOR INCREASING THE FLUID RESISTANCE OF WELL PRODUCTION TUBING INADVERTENTLY DROPPED IN AN OIL OR GAS WELL

BACKGROUND OF THE INVENTION (1) Field of the Invention

The present invention pertains to a pair of telescoping conduits attached to oil or gas well production tubing which is hung or being run in a cased hole. The telescoping conduits increase the fluid resistance of the tubing if it is dropped in the hole and descends through fluid contained in the casing. In particular, the pair of telescoping conduits are attached to the production tubing to reduce the risk of damage to the casing pipe and the tubing when a length of the production tubing having the telescoping conduits attached is inadvertently dropped into and through the casing. In addition, the invention will lessen the cost of "fishing" the dropped tubing out of the hole by reducing the chances of its becoming stuck when it hits bottom. By reducing the risk of damage to the casing and production tubing, the telescoping conduits will minimize the cost of retrieving the dropped tubing and will lessen the risk of loss of the well. In one embodiment the telescoping tubing is adapted to also separate gas from liquid entering the production tubing. A tapered bull plug is also provided to avoid damage to the conduits or dropped tubing when they hit the surface of the fluid.

(2) Description of the Related Art

It is well known in the prior art that gas or oil wells being prepared for production are provided with a casing pipe to prevent the walls of the well from caving in, to seal off any levels of strata containing water that communicate with the drilled well or fresh water zones and to confine any gas or oil to the strata level where they were encountered. Well casings are typically large diameter pipes and are available in a variety of standard sizes, weights, wall thicknesses, and lengths. Individual lengths or joints of casing pipe are connected together end to end as they are inserted downward into the drilled wells by couplings, also known in the art.

Several lengths or joints of casing connected end to end are typically employed in casing an oil or gas well. A joint is typically about 40 feet in length. The total length of joints of casing inserted downward into a drilled hole can reach thousands of feet, and casing will be run to the bottom of the hole and cemented in place. Production tubing is then inserted downward through the casing pipe in the same way that casing is run into the open hole. A pump may then be run down the tubing on rods, which are connected joint by joint at the surface. The uppermost rod, or "polished rod" is then tied on to the "horses head" of the surface pumping unit. Operation of the pumping unit activates the pump and conveys the fluid of the well upward through the production tubing and into the tanks or storage facilities on the surface.

The casing pipe in a gas or oil well is often the most expensive portion of the well's construction, representing as much as one-third of the cost of the oil or gas well. Damage to the casing pipe of a producing well can represent a substantial expense, not only for the repair of the casing pipe but also for the downtime of the productive well. Moreover, damaged casing can make it impossible to run production tubing or other equipment into the well resulting in the loss of the well.

Casing pipe of production wells can be damaged in a number of ways and the productivity of the well itself affected. As an example, an oil well work crew is pulling the production tubing of an oil well that is ten thousand feet deep to service the well and inspect the tubing. Tubing is usually pulled out of the well in "stands" of two or three joints. A stand is unscrewed and stood in the derrick of the rig. The tubing in the hole is suspended at the surface by the application "slips". The fluid level of the well is, for example, at seven thousand feet below the surface. The crew has all but two thousand feet of the production tubing pulled out of the hole when they fail to properly close the slips around the tool joint at the surface, and the two thousand foot length of tubing weighing about five tons, is dropped down the well. The cylindrical exterior configuration of the production tubing and its weight will cause it to hit the bottom of the well with considerable force. The fluid filling the bottom three thousand feet of the well will not have any significant effect on slowing the descent of the production tubing dropped down the well. The impact of the two thousand feet of production tubing at the bottom of the hole will result in the production tubing being corkscrewed, bent and twisted, possibly causing the casing to rupture. The twisted tubing may become jammed and stuck in the hole. The result is a very expensive fishing job, the replacement of both casing and tubing, and possibly the loss of a productive well.

For another example, take the same well during its normal production phase. The string of production tubing is 7,500 feet in length, hung at the well head and secured at the bottom with a tubing anchor, which locks onto the casing. The pump is at 7,500 feet also, at the end of the string of rods which is clamped onto the horses head of the surface pump. The tubing parts one joint from the surface, the tubing anchor fails to hold and 7,470 feet of tubing and rods, weighing about 28 tons, fall to the bottom at 10,000 feet, corkscrewing, bending and jamming inside the casing, causing the loss of the hole.

SUMMARY OF THE INVENTION

The present invention provides a pair of telescoping conduits that are attached as an integral part of production tubing and increase the fluid resistance of the tubing and significantly slow the descent of the tubing through liquid contained in the casing when the tubing is inadvertently dropped, or breaks loose. The invention also provides a tapered bull plug that also avoids damage to dropped production tubing.

In the best mode of the invention, the pair of telescoping conduits are attached to the bottom end of a length of production tubing run down into a well casing pipe. A conventional bull plug may be attached to the bottom of the telescoping conduits, or the tapered bull plug of the present invention may be attached to the bottom of the conduits. The second, bottommost conduit of the pair is attached to the first conduit for telescoping movement relative to the first conduit. The second conduit is comprised of a pair of concentric tubular members, with the inner tubular member being received for telescoping movement in the interior of the first conduit and the outer tubular member being configured for telescoping movement over the exterior of the first conduit. A plurality of inlet openings are provided through the lower end of the inner tubular member providing fluid communication through the inlets to the interior bores of the pair of conduits. A plurality of fluid passage openings are provided through the upper end of the outer tubular member providing fluid communication from an exterior environment of the pair of conduits through the plurality of fluid passages. An annular void separates the inner and outer tubular members and provides fluid communication between the fluid passages in the outer member and the inlet openings in the inner member.

In use, with the pair of telescoping conduits attached to the lower end of a length of production tubing as the tubing is run down into a well casing pipe, the second conduit is suspended in its telescopically extended position relative to the first conduit. With the pair of conduits submerged in liquid at the bottom of the well casing pipe, communication of the liquid is provided through the fluid passages in the outer tubular member of the second conduit, axially downward through the annular void between the inner and outer tubular members of the second conduit, and through the plurality of inlets in the inner tubular member to the interior bores of the pair of conduits and the interior bore of the production tubing. The vertical spacing of the fluid passages in the outer tubular member from the inlet openings in the inner tubular member serves to separate gas suspended in liquids communicated through these two sets of openings as the liquid flows vertically downward through the annular void between the inner and outer tubular members of the second conduit.

Should a length of production tubing with the apparatus of the invention attached be inadvertently dropped down through the casing pipe, the second conduit will move telescopically relative to the first conduit on impact of the apparatus of the invention with the surface of the liquid contained at the bottom of the casing pipe. On telescoping movement of the second conduit relative to the first conduit, the inner tubular member moves into the interior bore of the first conduit and the outer tubular member moves over the exterior surface of the first conduit, resulting in the first conduit blocking fluid communication through both the inlet openings of the inner tubular member and the fluid passages of the outer tubular member. This blockage of fluid communication between these two sets of openings prevents the flow of the liquid contained in the well casing pipe into the interior bore of the production tubing, causing all of the liquid contained in the casing pipe to flow over the exterior surface of the production tubing. The restricted area between the exterior surface of the production tubing and the interior surface of the casing pipe through which the displaced liquid of the well is to flow results in the liquid gradually slowing the descent of the dropped production tubing through the casing pipe. In this manner, the telescoping conduits of the present invention prevent the dropped lengths of production tubing from impacting with great force at the bottom of the well casing reducing significantly the risk of damage to the casing pipe, the production tubing, or to the well itself.

The modified bull plug that may be used in conjunction with the telescoping conduits of the invention has a configuration that reduces the impact forces exerted on lengths of production tubing inadvertently dropped through a well casing as the lengths of tubing impact with the surface of liquid contained in the casing pipe. The bull plug of the invention has an elongated configuration that tapers downwardly to an apex of the plug. The configuration of the plug pierces the surface of the liquid at impact and thereby significantly reduces the impact force exerted on the dropped lengths of production tubing.

BRIEF DESCRIPTION OF THE DRAWINGS

Further objects and features of the present invention are revealed in the following detailed descriptions of the preferred embodiments of the invention and in the drawing figures wherein.

DESCRIPTION OF THE PREFERRED EMBODIMENTS

Figure 1:
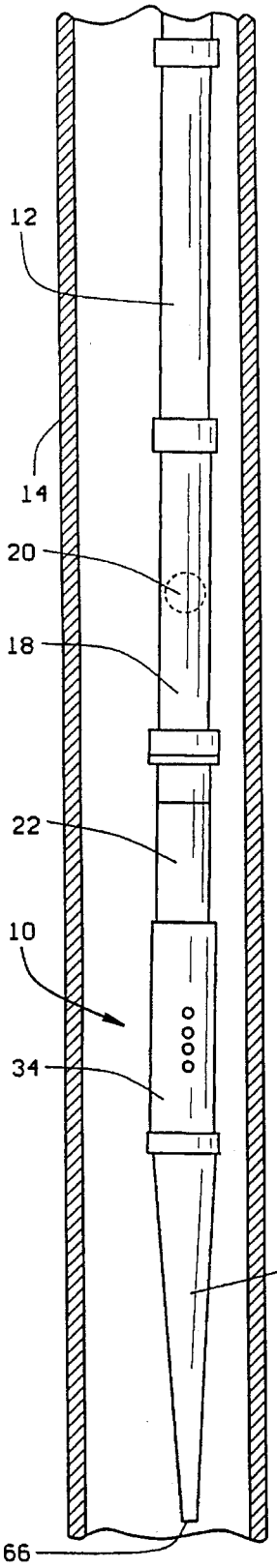
FIG. 1 is a partial elevation view, in section, of an operative environment of the telescoping conduits and tapered bull plug of the present invention.

FIG. 1 shows the first embodiment of the telescoping conduits 10 of the present invention in their operative environment. The conduits are shown secured to a length of production tubing 12 contained inside a casing 14 of an oil or gas well. The tapered bull plug 16 of the invention is shown connected to the bottom of the telescoping conduits 10 and a conventional seat nipple containing a bottom hole pump shown schematically 20 is connected to the top of the telescoping conduits 10 between the conduits and the lengths of production tubing 12. The telescoping conduits 10 of the present invention are provided with conventional couplings at their upper and lower ends in order to enable the conduits to be easily connected with conventional lengths of production tubing 12 and conventional bull plugs.

Figure 2:
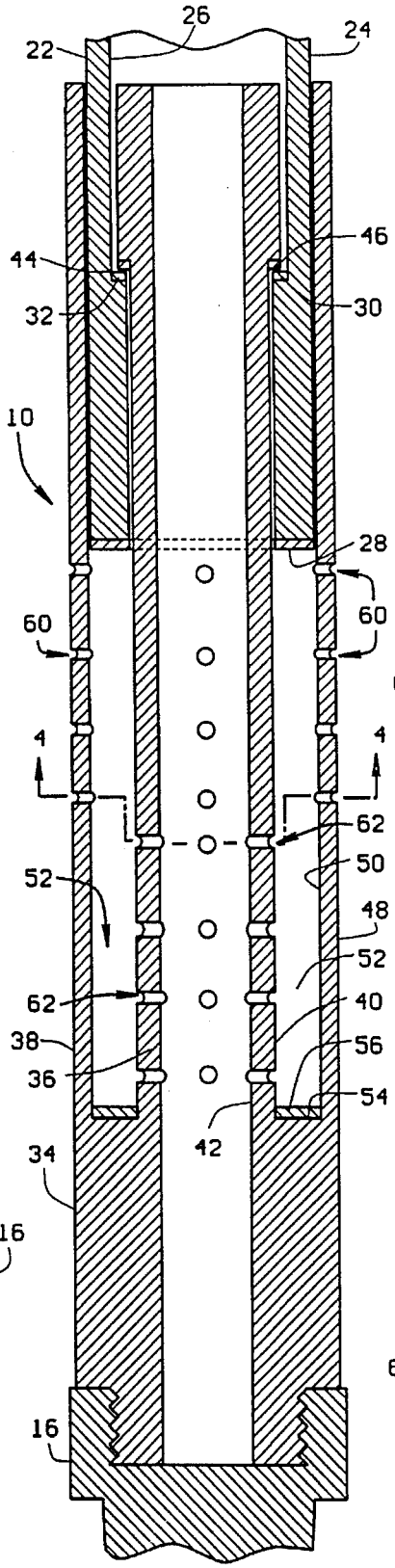
FIG. 2 is a partial elevation view, in section, of a first operative position of the telescoping conduits of the invention.
Figure 3:
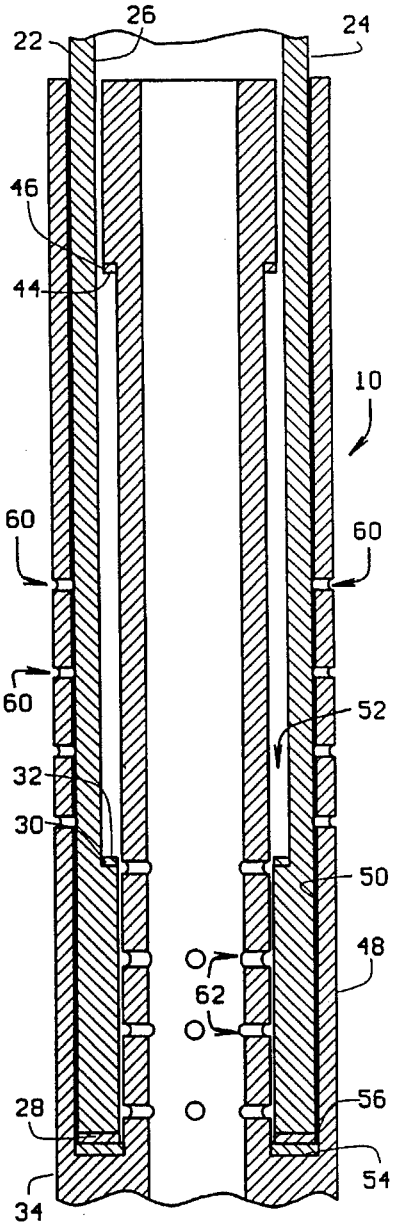
FIG. 3 is a partial elevation view, in section, of a second operative position of the conduits.
Figure 4:
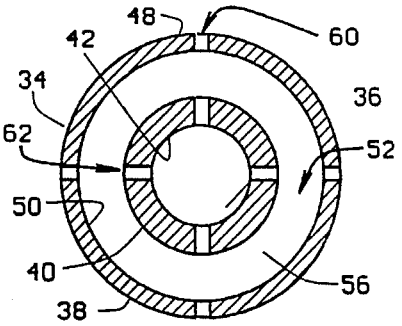
FIG. 4 is a plan view, in section, taken along the line 4—4 of FIG. 2.

FIG. 2 shows a partial view of the telescoping conduits 10 in cross section. The conduits are comprised of a first conduit 22 having a generally cylindrical exterior surface 24 and a cylindrical interior surface 26 surrounding an interior bore of the conduit. The upper end of the first conduit 22 (not shown in FIG. 2) is provided with a conventional coupling for connecting the conduit to lengths of production tubing. The bottom end of the first conduit 22 is provided with an annular gasket seal 28 surrounding the exit of the interior bore from the first conduit. An annular shoulder 30 is formed in the interior surface 26 of the first conduit adjacent the conduit bottom end. A second annular sealing gasket 32 is provided on the annular shoulder 30. The interior bore of the first conduit 22 extends upward and communicates in fluid communication with the interior bore of the lengths of production tubing 12.

The telescoping conduits 10 of the invention also include a second conduit 34. The second conduit 34 is comprised of a pair of concentric tubular members including an inner tubular member 36 and an outer tubular member 38. The inner tubular member has a generally cylindrical exterior surface 40 and a generally cylindrical interior surface 42 surrounding an interior bore of the second conduit 34 that communicates in fluid communication with the interior bore of the first conduit 22. An annular shoulder 44 is formed in the cylindrical exterior surface 40 of the inner tubular member dividing the axial length of the exterior surface into two separate sections having two different circumferences. An annular sealing gasket 46 is provided on the shoulder 44. As best seen in FIG. 2, the two different exterior circumferences of the inner tubular member exterior surface 40 and the two different inner circumferences of the first conduit interior surface 26 enable the inner tubular member 36 to slide axially through the interior bore of the first conduit 22. The annular shoulder 30 of the first conduit interior surface 26 and the annular shoulder 44 of the inner tubular member exterior surface 40 prevent the inner tubular member 36 from being removed from the interior bore of the first conduit 22.

The outer tubular member 38 has a generally cylindrical exterior surface 48 and a generally cylindrical interior surface 50. The interior surface 50 has a circumference dimensioned to enable the outer tubular member 38 to slide telescopically over the exterior surface 24 of the first conduit. The dimensioning of the outer tubular member interior surface 50 produces an annular void 52 between the outer tubular member interior surface 50 and the inner tubular member exterior surface 40. The dimensioning of the annular void 52 enables the lower end of the first conduit 22 between the sealing gasket 28 at the bottom of the first conduit 22 and the sealing gasket 32 at the annular shoulder 30 of the first conduit to slide freely through the annular void 52. A shoulder 54 is provided on the second conduit 34 at the bottom of the annular void 52 spanning radially between the inner tubular member 36 and the outer tubular member 38. An annular gasket 56 is provided on this annular shoulder 54.

A plurality of fluid passage openings 60 are provided through the outer tubular member 38 of the second conduit. As seen in FIG. 2, the fluid passages 60 are positioned in the outer tubular member 38 spaced axially toward the top of the annular void 52. A plurality of inlet openings 62 are provided through the inner tubular member 36 positioned toward the bottom of the annular void 52 axially below the fluid passages 60 in the outer tubular member. The bottom of the second conduit interior bore is sealed closed by the tapered bull plug 16 attached to the bottom end of the second conduit. The bull plug 16 is shown attached by a complementary threaded connection to the bottom of the second conduit 34. Alternatively, other conventional connectors may be employed to attach the bull plug 16 to the bottom of the conduit 34.

The bull plug 16 of the invention is similar to prior art bull plugs in the manner in which it is attached to production tubing or the bottom of the telescoping conduits 10 of the invention. As stated earlier, the bull plug is shown attached to the second conduit 34 of the pair of conduits 10 by a complementary threaded connection. Alternatively, the bull plug may be attached to the telescoping conduits 10 or production tubing in any conventional manner. The construction of the bull plug is similar to conventional plugs except for its exterior configuration. As best seen in FIG. 1, the bull plug 16 has a tapered configuration that extends downwardly to an apex 66 of the plug.

It should be appreciated from the description of the telescoping conduits 10 presented above that the configurations of the cylindrical interior and exterior surfaces of the first and second conduits 22, 34 enable the second conduit 34 to telescope axially relative to the first conduit 22. The telescoping conduits 10 shown in FIGS. 1–4 are designed to perform two functions.

The first function performed by the telescoping conduits 10 of the present invention is to minimize gas locking of the well pump 20. In a pumping well, the ideal condition finds gas contained in the liquid, water and/or oil, will move in bubbles upward through the liquid contained in the well casing between the casing 14 and the production tubing 12 while the oil is pumped up through the production tubing. However, in many instances significant amounts of gas can enter the production tubing along with the oil. When this happens the gas may cause the pump from operating efficiently.

With the telescoping conduits 10 of the present invention, oil entering the fluid passages 60 of the outer tubular member 38 will be caused to flow downward through the annular void 52 surrounding the inner tubular member 36. Because the gas is lighter than the oil (and water if present in the well) the vertical spacing between the fluid passages 60 of the outer tubular member 38 and the inlet opening 62 in the inner tubular member 36 will cause the gas to separate from the oil (and water) as it flows downward through the annular void 52 toward the inlet opening 62 in the inner tubular member 36. The gas passes through the spacing between the exterior surface of the first conduit 22 and the interior surface of the second conduit outer tubular member 38 and then upward through the well between the casing 14 and the production tubing 12. The oil (and water) from which the gas has been separated passes through the inlet opening 62 in the inner tubular member 36 and then is pumped upward through the interior bores of the second conduit 34, first conduit 22 and the production tubing 12.

The second and more significant function performed by the telescoping conduits 10 of the invention is to gradually slow the descent of lengths of production tubing with the conduits attached inadvertently dropped down through a well casing as the telescoping conduits 10 and attached production tubing pass through liquid contained in the casing. If the production tubing 12 with the telescoping conduits 10 attached is inadvertently dropped through a well casing pipe the impact of the bull plug 16 with the surface of liquid contained in the casing will force the second conduit 34 to telescope upward from its suspended second position relative to the first conduit 22 shown in FIG. 2 to its retracted second position relative to the first conduit 22 shown in FIG. 3. It can be seen in FIG. 3 that with the second conduit 34 moved axially upward relative to the first conduit 22 to its second position relative to the first conduit, the fluid passages 60 through the outer tubular member 38 and the inlet openings 62 through the inner tubular member 36 are both blocked by the first conduit 22. The first conduit's 22 blocking of the fluid passages 60 and inlet openings 62 prevents the liquid contained in the casing from flowing through these two sets of openings into and upward through the interior bores of the pair of conduits 10 and the production tubing 12. This causes all of the liquid contained in the casing to be displaced upward through the restricted radial spacing between the exterior surfaces of the second conduit 34 and production tubing 12 and the interior surface of the casing 14. This maximizes the fluid resistance of the production tubing and attached telescoping conduits 10 dropped through the liquid contained in the casing and gradually slows their descent through the liquid. The slowed descent of the production tubing and attached telescoping conduits 10 through the liquid contained in the casing reduces the impact of the tubing and conduits at the bottom of the well thereby reducing the risk of loss or damage to the well casing and the production tubing due to this impact.

The elongated configuration of the bull plug 16 serves to reduce the impact of the production tubing 12 and attached telescoping conduits 10 with the surface of the liquid contained in the well casing 14. The downwardly tapering configuration of the bull plug to the plug's apex 16 serves to pierce the surface of liquid contained in the casing as the production tubing and conduits are dropped through the casing interior. The piercing action performed by the tapered bull plug 16 lessens the impact force exerted on the production tubing and telescoping conduits on impact of the tubing end conduits with the liquid surface, thereby reducing the risk of damage to the production tubing and conduits on their impact with the liquid surface.

Figure 5:
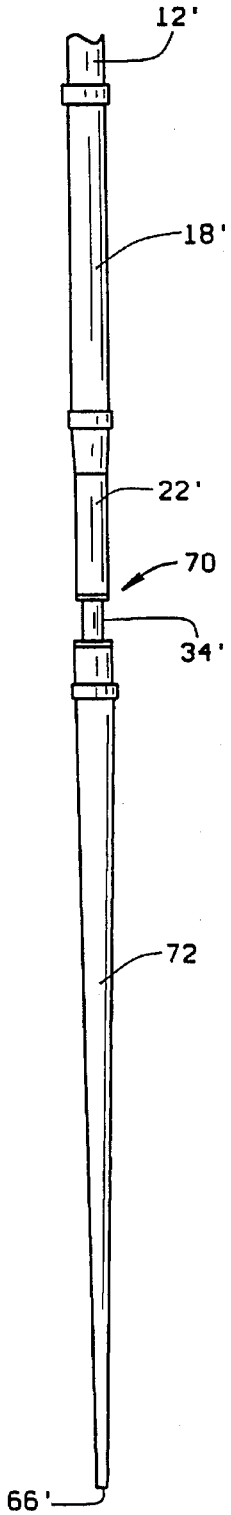
FIG. 5 is a partial elevation view of a second embodiment of the telescoping conduits and the elongated bull plug of the present invention.
Figure 6:
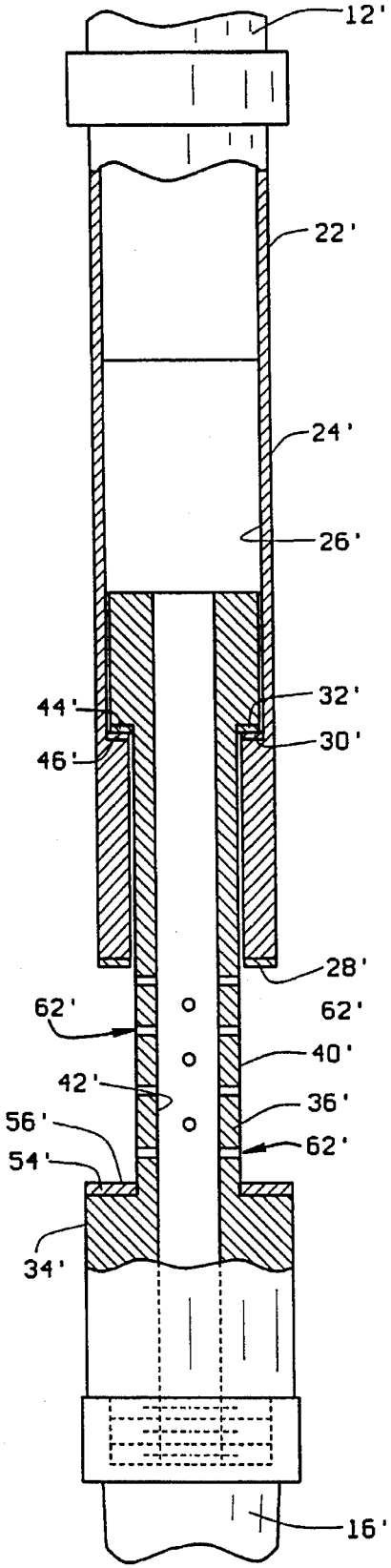
FIG. 6 is a partial elevation view, in section, of a first operative position of the second embodiment of the telescoping conduits of the invention.
Figure 7:
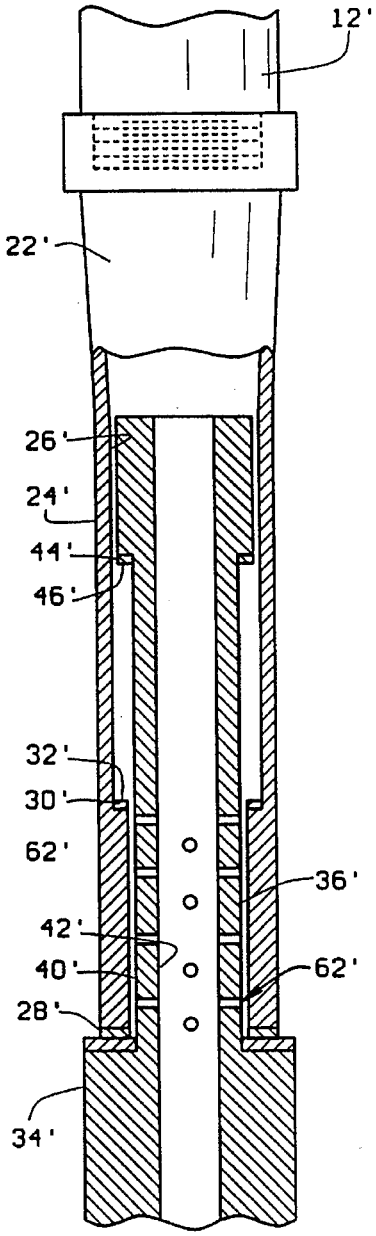
FIG. 7 is a partial elevation view, in section, of a second operative position of the second embodiment of the telescoping conduits.

FIGS. 5–7 show variant embodiments of the telescoping conduits and the tapered bull plug of the present invention. The embodiment of the telescoping conduits 70 shown in FIGS. 5–7 is substantially identical to the earlier described embodiment shown in FIGS. 1–4 except for the removal of the outer tubular member from the second conduit. The remaining component parts of the embodiment of the telescoping conduits 70 shown in FIGS. 5–7 are substantially identical to the component parts of the first described telescoping conduits and are identified by the same reference numbers followed by, a prime (').  The functioning of the second embodiment of the telescoping conduits 70 is identical to the first described embodiments in slowing the rate of descent of dropped lengths of tubing through liquid contained in a well casing. The only difference between the embodiment of the telescoping conduits 70 and the previously described embodiment is that the second embodiment shown in FIGS. 5–7 will not perform the gas separating function of the previously described embodiment. Because the component parts and the functioning of the second embodiment are substantially identical to the first embodiment, they will not be described again here.

The second embodiment of the tapered bull plug 72 shown in FIG. 5 is substantially identical to the previously described embodiment except that its configuration is further elongated from that shown in FIG. 1. Apart from this, the second embodiment of the bull plug 72 functions in the same manner as the first described embodiment and will not be further described here.

While the present invention has been described by reference to a specific embodiment, it should be understood that modifications and variations of the invention may be constructed without departing from the scope of the invention defined in the following claims.

What is claimed is:

1. An apparatus adapted to be attached to production tubing to reduce the risk of damage to the production tubing due to the production tubing being inadvertently dropped down a well, the apparatus comprising:

a first conduit having an interior bore extending axially therein, the first conduit being adapted to be attached to production tubing where the interior bore is connected in fluid communication with an interior bore of the production tubing;

a second conduit having an interior bore extending axially therein, the second conduit being attached to the first conduit for movement of the second conduit between first and second positions relative to the first conduit; and means for providing fluid communication between an exterior environment of the first and second conduits and the interior bores of the first and second conduits and for separating gas from fluid communicated from the exterior environment to the interior bores of the first and second conduits when the second conduit is positioned in the first position relative to the first conduit, and for disrupting fluid communication between the exterior environment and the interior bores of the first and second conduits when the second conduit is positioned in the second position relative to the first conduit.

2. The apparatus of claim 1, wherein:

the means providing fluid communication between the exterior environment and the interior bores of the first and second conduits includes at least one inlet through one of the first and second conduits providing fluid communication between the exterior environment and the interior bores of the first and second conduits when the second conduit is positioned in the first position relative to the first conduit, the inlet being blocked by the other of the first and second conduits disrupting fluid communication through the inlet when the second conduit is moved to the second position relative to the first conduit.

3. The apparatus of claim 1, wherein:

the second conduit has a plurality of inlets therethrough providing fluid communication between the exterior environment and the interior bores of the first and second conduits when the second conduit is positioned in the first position relative to the first conduit, and when the second conduit is moved to the second position relative to the first conduit the first conduit blocks the plurality of inlets and disrupts fluid communication between the exterior environment and the interior bores of the first and second conduits through the inlets.

4. The apparatus of claim 3, wherein:

the second conduit is received within the interior bore of the first conduit for axially telescoping movement of the second conduit into the first conduit interior bore to the second position of the second conduit relative to the first conduit, and out of the first conduit interior bore to the first position of the second conduit relative to the first conduit.

5. The apparatus of claim 4, wherein:

the second conduit is comprised of a pair of concentric tubular members with a first tubular member having the plurality of inlets therethrough and also being received within the first conduit interior bore for axially telescoping movement of the first tubular member into and out of the first conduit interior bore, and a second tubular member extending around the first tubular member and the first conduit for axially telescoping movement of the second tubular member over the first conduit.

6. The apparatus of claim 5, wherein:

a plurality of fluid passages are provided through the second tubular member in an axially spaced relation to the plurality of inlets through the first tubular member, whereby liquid passing through the fluid passages is caused to flow axially downward to flow through the inlets into the second conduit interior bore thereby separating gas from the liquid.

7. An apparatus adapted to be attached to production tubing and suspended with the production tubing inside a well to reduce the risk of damage to the production tubing due to the production tubing being inadvertently dropped down the well, the apparatus comprising:

a first conduit having an interior bore extending axially therein, the first conduit being adapted to be attached to the production tubing where the interior bore is connected in fluid communication with an interior bore of the production tubing;

a second conduit having an interior bore extending axially therein, the second conduit being attached to the first conduit for movement of the second conduit between first and second positions relative to the first conduit; and, means for providing fluid communication between an interior environment of the well and the interior bores of the first and second conduits when the first and second conduits are suspended in the well by the production tubing attached to the first conduit causing the second conduit to move to its first position relative to the first conduit, and for disrupting fluid communication between the interior environment of the well and the interior bores of the first and second conduits when the first and second conduits are dropped through the well causing the second conduit to move to its second position relative to the first conduit;

the second conduit is attached to the first conduit for axially telescoping movement of the second conduit between the first and second positions relative to the first conduit in response to the first and second conduits being dropped through the well; and the means providing fluid communication between the well interior environment and the interior bores of the first and second conduits also separates gas from fluid communicated from the exterior environment to the interior bores of the first and second conduits by the means.

8. An apparatus adapted to be attached to production tubing to avoid damage to the production tubing due to the production tubing being inadvertently dropped down a well, the apparatus comprising:

a first conduit having an interior bore extending therethrough, the first conduit being adapted to be attached to production tubing where the interior bore is connected in fluid communication with an interior bore of the production tubing; and means provided on the first conduit for alternatively providing fluid communication between an exterior environment of the first conduit and the first conduit interior bore, and disrupting fluid communication between the exterior environment and the first conduit interior bore, said means providing fluid communication between the exterior environment and the first conduit interior bore in response to said means being freely suspended from the first conduit, and said means disrupting fluid communication between the exterior environment and the first conduit interior bore in response to said means being dropped and impacting with a surface of a liquid, said means also separating gas from a liquid communicated from the exterior environment to the first conduit interior bore.

* * * * *